US008357225B2

(12) United States Patent
Li et al.

(10) Patent No.: US 8,357,225 B2
(45) Date of Patent: Jan. 22, 2013

(54) METHOD FOR MAKING MAGNESIUM-BASED COMPOSITE MATERIAL

(75) Inventors: Wen-Zhen Li, Beijing (CN); Shi-Ying Liu, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 12/833,950

(22) Filed: Jul. 10, 2010

(65) Prior Publication Data

US 2011/0154952 A1 Jun. 30, 2011

(30) Foreign Application Priority Data

Dec. 25, 2009 (CN) ..... 2009 1 0189486

(51) Int. Cl.
*C22B 26/22* (2006.01)

(52) U.S. Cl. ..... 75/604; 148/538; 148/558; 164/900

(58) Field of Classification Search ..... 75/604; 148/538, 558; 164/900
See application file for complete search history.

(56) References Cited

U.S. PATENT DOCUMENTS

| | | | | |
|---|---|---|---|---|
| 3,936,298 | A * | 2/1976 | Mehrabian et al. | 148/400 |
| 6,308,768 | B1 * | 10/2001 | Rice et al. | 164/133 |
| 6,769,473 | B1 * | 8/2004 | Adachi et al. | 164/71.1 |
| 6,860,314 | B1 | 3/2005 | Koide et al. | |
| 7,216,690 | B2 * | 5/2007 | Han et al. | 164/113 |
| 7,509,993 | B1 | 3/2009 | Turng et al. | |
| 7,712,512 | B2 | 5/2010 | Suganuma et al. | |
| 7,921,899 | B2 * | 4/2011 | Chan et al. | 164/97 |
| 2009/0162574 | A1 | 6/2009 | Li et al. | |
| 2010/0276104 | A1 * | 11/2010 | McCullough | 164/113 |

FOREIGN PATENT DOCUMENTS

| | | |
|---|---|---|
| CN | 101439407 A | 5/2009 |
| JP | 58100643 | 6/1983 |
| JP | 2004136363 | 5/2004 |
| JP | 2007331005 | 12/2007 |

OTHER PUBLICATIONS

Gao G. et al., Mechanical properties and microstructure of SiC-reinforced Mg-(2,4)Al-Si nanocomposites fabricated by ultrasonic cavitation based solidification processing, Materials Science and Engineering A,2008, 357-362,486.

* cited by examiner

*Primary Examiner* — George Wyszomierski
*Assistant Examiner* — Tima M McGuthry Banks
(74) *Attorney, Agent, or Firm* — Altis Law Group, Inc.

(57) ABSTRACT

The present disclosure provides a method for making magnesium-based composite material. The method comprises the following steps. Firstly, a semi-solid-state magnesium-based material is provided. Secondly, at least one nanoscale reinforcement is added into the semi-solid-state magnesium-based material to obtain a semi-solid-state mixture. Thirdly, the semi-solid-state mixture is heated to a liquid-state mixture. Fourthly, the liquid-state mixture is ultrasonically processed. Fifthly, the liquid-state mixture is cooled to obtain the magnesium-based composite material.

18 Claims, 2 Drawing Sheets

METHOD FOR MAKING MAGNESIUM-BASED COMPOSITE MATERIAL

CROSS-REFERENCE TO RELATED APPLICATIONS

This application claims all benefits accruing under 35 U.S.C. §119 from China Patent Application No. 200910189486.7, filed on 2009 Dec. 25, in the China Intellectual Property Office, the disclosure of which is incorporated herein by reference. This application is related to commonly-assigned application entitled, "METHOD FOR MAKING ALUMINIUM-BASED COMPOSITE", filed on Jul. 10, 2010 with an application Ser. No. 12/833,949, now U.S. Pat. No. 8,287,622.

BACKGROUND

1. Technical Field

The present disclosure relates to a method for making magnesium-based composite material.

2. Description of Related Art

Nowadays, various alloys have been developed for special applications. Among these alloys, magnesium alloys have relatively superior mechanical properties, such as low density, good wear resistance, and high elastic modulus. However, the toughness and the strength of the magnesium alloys are not able to meet the increasing needs of the automotive and aerospace industry for tougher and stronger alloys.

To address the above-described problems, magnesium-based composite materials have been developed. In the magnesium-based composite material, nanoscale reinforcements (e.g. carbon nanotubes and carbon nanofibers) are mixed with the magnesium material or alloy. The nanoscale reinforcements can be carbon nanotubes, silicon carbide, aluminum oxide, titanium carbide, or boron carbide.

In an article entitled, "Mechanical properties and microstructure of SiC-reinforced Mg-(2,4)Al-1Si nanocomposites fabricated by ultrasonic cavitation based solidification processing" by G. Gao, et al., Materials Science and Engineering A, 486, 357-362 (2008), a method for making magnesium-based composite material is disclosed. The method comprises the following steps: providing a liquid-state Mg—(2,4)Al-1Si alloy of 800 grams at a temperature of 700° C.; dipping a ultrasonic probe into the liquid-state Mg-(2,4)Al-1Si alloy for about 25 millimeters to about 31 millimeters in depth and ultrasonically processing the alloy at 700° C. Feeding silicon carbide nanoscale powders into the alloy during the ultrasonic processing to obtain a magnesium-based composite material in which the weight percentage of the silicon carbide nanoscale powders is 2 wt %. Performing the ultrasonic process for about 15 minutes and increasing the temperature of the magnesium-based composite material to 725° C. at the same time. Pouring the magnesium-based composite material into a mold. However, using the above-described method, the silicon carbide nanoscale powders are dispersed only by ultrasonically processing. Because a density of the silicon carbide nanoscale powders is very small, the silicon carbide nanoscale powders trend to stay on a surface of the liquid-state alloy and are not easily dispersed uniformly into the whole magnesium-based composite material.

What is needed, therefore, is to provide a method for making a magnesium-based composite material in which the nanoscale reinforcements are dispersed uniformly.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
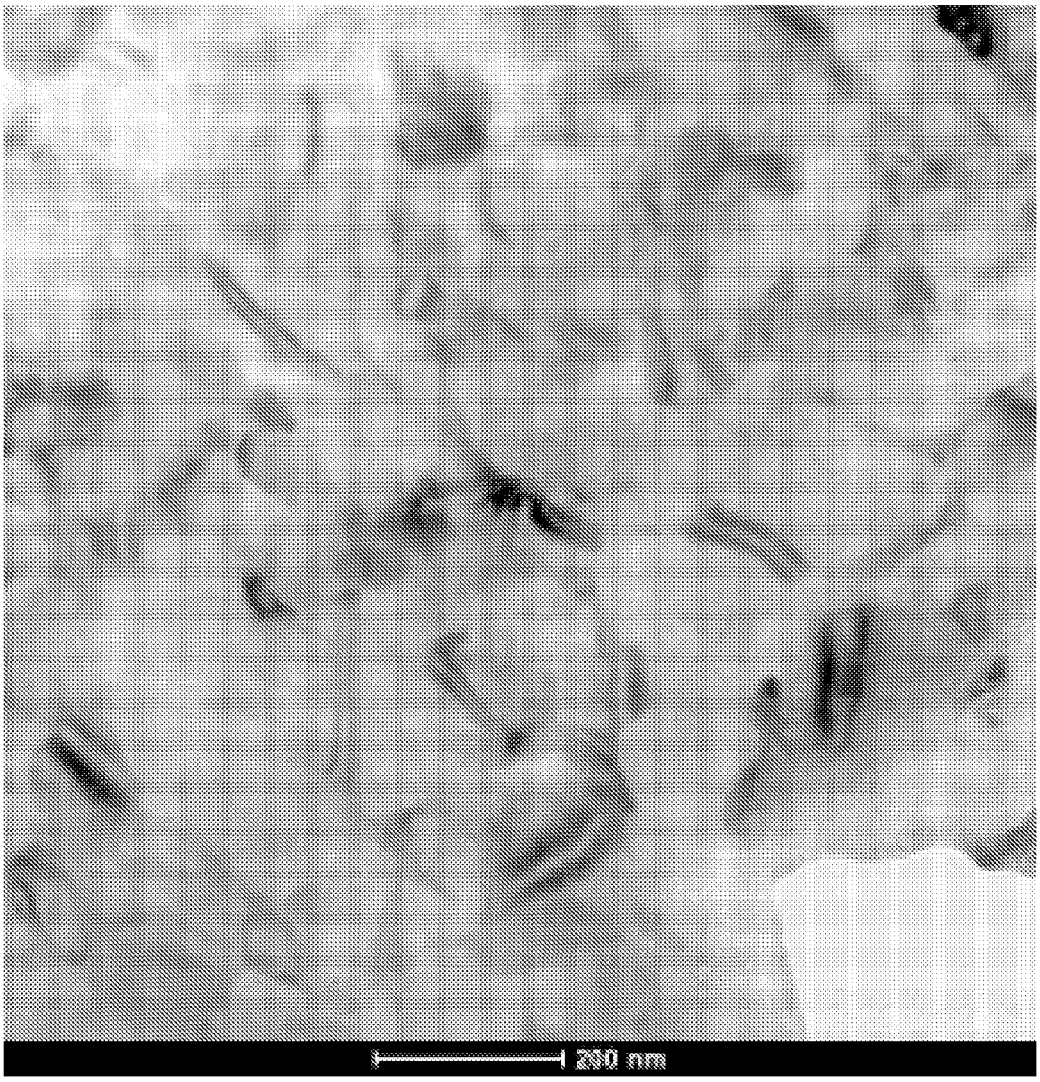
FIG. 1 illustrates a transmission electron microscope image of a magnesium-based composite material produced by example 8.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

An embodiment of a method for making a magnesium-based composite material of one embodiment includes the following steps:

S10, providing a semi-solid-state magnesium-based material;

S20, stirring the semi-solid-state magnesium-based material and adding at least one nanoscale reinforcement into the semi-solid-state magnesium-based material to obtain a semi-solid-state mixture;

S30, heating the semi-solid-state mixture to a liquid-state mixture;

S40, high intensity ultrasonic processing the liquid-state mixture;

S50, cooling the liquid-state mixture to obtain the magnesium-based composite material.

In step S10, the magnesium-based material can be pure magnesium or magnesium-based alloys. The magnesium-based alloys include magnesium (Mg) and other metals such as zinc (Zn), manganese (Mn), aluminum (Al), thorium (Th), lithium (Li), silver (Ag), calcium (Ca), or any combinations thereof. The semi-solid-state magnesium-based material can be provided in a protective gas or a vacuum. The protective gas or vacuum can prevent the magnesium in the magnesium-based material from being oxidated or burning. The protective gas can be a nitrogen ($N_2$), a noble gas, or a mixed gas of carbon dioxide and sulfur hexafluoride. In one embodiment, the protective gas is a mixed gas of carbon dioxide and sulfur hexafluoride and exists during step S10, step S20, step S30, step S40 and step S50. The volume percentage of the sulfur hexafluoride in the mixed gas can range from about 1.7% to about 2.0%.

In one embodiment, a method for making the semi-solid-state magnesium-based material includes the following steps:

S101, providing a solid-state magnesium-based material;

S102, heating the solid-state magnesium-based material to a temperature between a liquidus line and a solidus line of the magnesium-based material in the protective gas to obtain the semi-solid magnesium-based material; and S103, keeping the temperature of the semi-solid magnesium-based material for a period of time.

In S101, the solid-state magnesium-based material can be pure magnesium particles, magnesium-based alloy particles or magnesium-based alloy castings.

In S102, the solid-state magnesium-based material can be heated by an electric resistance furnace. The electric resistance furnace can be an electric resistance crucible furnace.

The solid-state magnesium-based material can be disposed in an argil-graphite crucible or a stainless steel container before heating.

In S103, the time for keeping the temperature of the semi-solid magnesium-based material can range from about 10 minutes to about 60 minutes to avoid the solid-state magnesium-based material existing in local regions of the semi-solid magnesium-based material.

In one embodiment, a method for making the semi-solid-state magnesium-based material includes the following steps:

S111, providing a solid-state magnesium-based material;

S112, heating the solid-state magnesium-based material to a temperature 50° C. higher than the liquidus lines of the magnesium-based material to obtain a liquid-state magnesium-based material; and S113, decreasing the temperature of the magnesium-based material to a temperature between the liquidus line and the solidus line of the magnesium-based material to obtain the semi-solid magnesium-based material.

This method allows the materials both inner portion and outer portion of the magnesium-based material in the semi-solid-state.

In step S20, the nanoscale reinforcements can be carbon nanotubes(CNTs), silicon carbides(SiC), aluminum oxides ($Al_2O_3$), titanium carbides(TiC), boron carbides ($B_4C$) or any combinations thereof. The weight percentage of the nanoscale reinforcements in the magnesium-based composite material can range from about 0.5% to about 5.0%. The nanoscale reinforcements can be particles with diameters ranging from about 1.0 nanometer to about 100 nanometers. An outer diameter of each CNT can range from about 10 nanometers to about 50 nanometers. A length of each CNT can range from about 0.1 micrometres to about 50 micrometres. Before being added into the semi-solid-state magnesium-based material, the nanoscale reinforcements can be heated to a temperature in a range from about 300° C. to about 350° C. for removing water absorbed by surfaces of the nanoscale reinforcements. The nanoscale reinforcements can also be used in other embodiments, for example, the nanoscale reinforcements can be used in the examples 1-8.

In one embodiment, the magnesium-based material can be stirred during the process of adding the nanoscale reinforcements therein to uniformly disperse the nanoscale reinforcements into the whole magnesium-based material. The method for stirring the magnesium-based material can be intense agitation. A method of the intense agitation can be an ultrasonic stirring or an electromagnetic stirring. The method of the electromagnetic stirring can be implemented by an electromagnetic stirrer. The method of the ultrasonic stirring can be implemented by a device having a number of agitating vanes. The agitating vanes can be two-layer type or three-layer type. The speed of the agitating vanes can range from about 200 r/min to about 500 r/min. The time of the intensely agitating can range from about 1 minute to about 5 minutes.

When the magnesium-based material is stirred, the nanoscale reinforcements are added into the magnesium-based material slowly and continuously so as to uniformly disperse the nanoscale reinforcements. If the nanoscale reinforcements are added into the magnesium-based material at one time, the nanoscale reinforcements will be gathered together to form a number of nanoscale reinforcement clusters. In one embodiment, the nanoscale reinforcements are added into the magnesium-based material via a steel tube. In one embodiment, the nanoscale reinforcements are added into the magnesium-based material via a funnel or a sifter having a plurality of nano-sized holes. By the above methods, the speed of adding the nanoscale reinforcements can be controllable so that the nanoscale reinforcements are dispersed into the magnesium-based material uniformly.

Since the semi-solid-state magnesium-based material is soft, the nanoscale reinforcements can be easily added into the magnesium-based material and prevented from being damaged. Furthermore, since a viscous resistance of semi-solid-state magnesium-based material is large, the nanoscale reinforcements are astricted in the magnesium-based material making the nanoscale reinforcements hard to rise and fall within the magnesium-based material. A swirl is produced when the magnesium-based material is being stirred. Following the centrifugal force of the swirl motion, the nanoscale reinforcements can be dispersed into the whole magnesium-based material uniformly. Therefore, the nanoscale reinforcements are uniformly dispersed into the whole magnesium-based material in step S20.

In step S30, the semi-solid-state mixture can be heated to a liquid-state mixture in protective gas. The temperature of the semi-solid-state mixture is increased to a temperature higher than the liquidus line to obtain the liquid-state mixture. By increasing the temperature of the resistance furnace, the temperature of the semi-solid-state mixture is increased following the temperature of the resistance furnace.

In step S40, the high intensity ultrasonic processing can uniformly disperse the nanoscale reinforcements in microcosmic areas of the liquid-state mixture. A frequency of the high intensity ultrasonic processing can range from about 15 KHz to about 20 KHz. A maximum output power of the high intensity ultrasonic processing can range from about 1.4 KW to about 4 KW. A time for the high intensity ultrasonic processing can range from about 10 minutes to about 30 minutes. The larger the quantity of the nanoscale reinforcements, the longer the time for the high-ultrasonic processing, and vice versa.

In liquid-state, the viscous resistance of the liquid-state mixture is small and a fluidity of the liquid-state mixture is good. During the high intensity ultrasonic processing, an ultrasonic cavitation effect of the liquid-state mixture is stronger than an ultrasonic cavitation effect of the semi-solid-state mixture. The effect of the ultrasonic cavitation can break the nanoscale reinforcement clusters in local areas of the liquid-state mixture. The nanoscale reinforcements are uniformly dispersed both in macroscopy and microcosmos in step S40.

In step S50, the way cooling the liquid-state mixture can be furnace cooling or natural convection cooling. In one embodiment, a method for cooling the liquid-state mixture can include the following steps:

S51, increasing the temperature of the liquid-state mixture to a pouring temperature;

S52, providing a mold;

S53, pouring the liquid-state mixture into the mold; and

S54, cooling the mold.

In step S51, the pouring temperature is a temperature of the liquid-state mixture which is to be poured into the mold. The pouring temperature is higher than the temperature of the liquidus lines of the liquid-state mixture. The pouring temperature can range from about 650° C. to about 700° C. The larger the quantity of the nanoscale reinforcements, the higher the pouring temperature, and vice versa.

In step S52, the material of the mold is metal. The mold can be preheated. The preheated temperature of the mold can range from about 200° C. to about 300° C. The preheated temperature of the mold has an effect on the properties of the magnesium-base composite material. If the preheated temperature of the mold is too low, the mold cannot be entirely filled by the liquid-state mixture and shrink holes may be formed in the magnesium-based composite material. If the temperature of the mold is too high, a size of the grains of the magnesium-based composite material will be too large such that the performance of the magnesium-based composite material will be reduced.

EXAMPLE 1

An embodiment of a method for making a magnesium-based composite material is provided. The components of the magnesium-based composite material are SiC and AZ91D magnesium alloy. The weight percentage of the SiC in the magnesium-based composite material is about 0.5 wt %. The method includes the following steps:

S111, providing an electrical resistant furnace and AZ91D magnesium alloy of 6 kilograms;

S112, heating the AZ91D magnesium alloy to about 650° C. in a protective gas using the electrical resistant furnace;

S113, decreasing the temperature of the magnesium-based alloy to about 550° C. and keeping the AZ91D magnesium alloy at about 550° C. for 30 minutes to obtain a semi-solid-state AZ91D magnesium alloy;

S114, mechanically stirring the semi-solid-state AZ91D magnesium alloy and adding a number of SiC particles of 30 grams into the AZ91D magnesium alloy during the ultrasonic stirring to obtain a semi-solid-state mixture;

S115, increasing the temperature of the semi-solid-state mixture to about 620° C. to obtain a liquid-state mixture;

S116, high intensity ultrasonic processing the liquid-state mixture;

S117, increasing the temperature of the liquid-state mixture to about 680° C. and pouring the liquid-state mixture into a mold; and S118, cooling the mold to obtain the magnesium-based composite material.

In step S111, the protective gas is a mixed gas of carbon dioxide and sulfur hexafluoride.

In step S114, a speed of the ultrasonic stirring is about 300 r/min, an average diameter of the SiC particles is about 40 nanometers. The SiC particles are preheated to about 300° C. before being added into the semi-solid-state AZ91D magnesium alloy.

In step S116, a frequency of the high intensity ultrasonic processing is about 20 KHz, a maximum power output of the high intensity ultrasonic processing is about 4 KW, and a time of the high intensity ultrasonic processing is about 10 minutes.

In step S117, the mold is preheated to a temperature of about 260° C.

EXAMPLE 2

An embodiment of a method for making a magnesium-based composite material is provided. The components of the magnesium-based composite material are SiC and AZ91D magnesium alloy, the weight percentage of the SiC in the magnesium-based composite material is 1.0 wt %. The method is similar to the method of example 1. The difference is that the weight of the AZ91D magnesium alloy is about 14 kilograms, the weight of the SiC particles is about 140 grams, the temperature to obtain the liquid-state mixture is about 650° C., and the time of the high intensity ultrasonic processing is about 15 minutes.

EXAMPLE 3

An embodiment of a method for making a magnesium-based composite material is provided. The components of the magnesium-based composite material are SiC and AZ91D magnesium alloy, the weight percentage of the SiC in the magnesium-based composite material is 1.5 wt %. The method includes the following steps:

S311, providing an electrical resistant furnace and a AZ91D magnesium alloy of 2 kilograms;

S312, heating the AZ91D magnesium alloy to a temperature of about 650° C. in a protective gas using the electrical resistant furnace;

S313, cooling the AZ91D magnesium alloy to a temperature of about 580° C. and keeping the AZ91D magnesium alloy at 580° C. for 30 minutes to obtain a semi-solid-state AZ91D magnesium alloy;

S314, mechanically stirring the semi-solid-state AZ91D magnesium alloy and adding 30 grams of SiC particles into the AZ91D magnesium alloy during the ultrasonic stirring to obtain a semi-solid-state mixture;

S315, heating the liquid-state mixture to about 620° C. to obtain a liquid-state mixture;

S316, high intensity ultrasonically processing the liquid-state mixture;

S317, heating the liquid-state mixture to 700° C. and pouring the liquid-state mixture into a mold; and S318, cooling the mold to obtain the magnesium-based composite material.

In step S312, the protective gas is mixed gas of carbon dioxide and sulfur hexafluoride.

In step S314, a speed of the ultrasonic stirring is about 300 r/min, an average diameter of the SiC particles is about 40 nanometers. The SiC particles are preheated to about 300° C. before being added into the semi-solid-state AA91D magnesium alloy.

In step S316, a frequency of the high intensity ultrasonic processing is about 20 KHz, a maximum power output of the high intensity ultrasonic processing is about 1.4 KW, and a time of the high intensity ultrasonic processing is about 15 minutes.

In S317, the mold is preheated to a temperature of about 260° C.

EXAMPLE 4

An embodiment of a method for making a magnesium-based composite material is provided. The components of the magnesium-based composite material are SiC and AZ91D magnesium alloy, the weight percentage of the SiC in the magnesium-based composite material is 2.0 wt %. The method is similar to the method of example 3. The difference is that the weight of the AZ91D magnesium alloy is about 2 kilograms and the weight of the SiC particles is about 40 grams.

EXAMPLE 5

An embodiment of a method for making a magnesium-based composite material. The components of the magnesium-based composite material are CNTs and AZ91D magnesium alloy. The weight percentage of CNTs in the magnesium-based material is 0.5 wt %. The method includes the following steps:

S511, providing an electrical resistant furnace;

S512, heating electrical resistant furnace to about 600° C. and introducing a protective gas into the electrical resistant furnace;

S513, providing a AZ91D magnesium alloy and disposing the AZ91D magnesium alloy into the electrical resistant furnace;

S514, increasing the temperature of the magnesium-based alloy to about 650° C.;

S515, decreasing the temperature of the AZ91D magnesium alloy to a temperature of about 550° C. and keeping the temperature of the AZ91D magnesium alloy at 550° C. for 30 minutes to obtain a semi-solid-state AZ91D magnesium alloy;

S516, ultrasonically stirring the semi-solid-state AZ91D magnesium alloy and adding CNTs into the AZ91D magnesium alloy during the ultrasonic stirring to obtain a semi-solid-state mixture;

S517, heating the liquid-state mixture to about 620° C. to obtain a liquid-state mixture;

S518, high intensity ultrasonic processing the liquid-state mixture while heating the liquid-state mixture;

S519, pouring the liquid-state mixture into a mold when the temperature of the liquid-state mixture is increased to 700° C.;

S520, cooling the mold to obtain the magnesium-based composite material.

In step S512, the protective gas is mixed gas of carbon dioxide and sulfur hexafluoride.

In step S513, a weight of the magnesium-based alloy is about 2 kilograms.

In step S516, a speed of the ultrasonically stirring is about 200 r/min. A weight of the CNTs is about 10 grams. An outer diameter of each of the CNTs can range from about 30 nanometers to about 50 nanometers. An inner diameter of each of the CNTs can range from about 5 nanometers to about 10 nanometers. A length of each of the CNTs can range from about 0.5 micrometers to about 2 micrometers.

In step S518, a frequency of the high intensity ultrasonic processing is about 20 KHz. The maximum power output of the high intensity ultrasonic processing is about 1.4 KW. A time of the high intensity ultrasonic processing is about 15 minutes.

In step S519, the mold is preheated to about 260° C.

EXAMPLE 6

An embodiment of a method for making a magnesium-based composite material is provided. The components of the magnesium-based composite material are CNTs and AZ91D magnesium alloy, a weight percentage of the CNTs in the magnesium-based composite material is about 1.0 wt %. The method is similar to the method of example 5. The difference is that the weight of the CNTs is about 20 grams. Compared to the AZ91D magnesium alloy, a tensile strength of the magnesium-based composite material including CNTs of 1.0 wt % is improved about 12%; a yield strength is improved about 10%; and the elongation percentage after being broken is improved about 40%.

EXAMPLE 7

An embodiment of a method for making a magnesium-based composite material is provided. The components of the magnesium-based composite material are CNTs and AZ91D magnesium alloy, the weight percentage of the CNTs in the magnesium-based composite material is 1.5 wt %. The method is similar to the method of example 5. The difference is that the weight of the CNTs is about 30 grams. Compared to the AZ91D magnesium alloy, the tensile strength of the magnesium-based composite material including CNTs of about 1.5 wt % is improved 22%, the yield strength is improved 21% and the elongation percentage after broken is improved about 42%.

EXAMPLE 8

Figure 2:
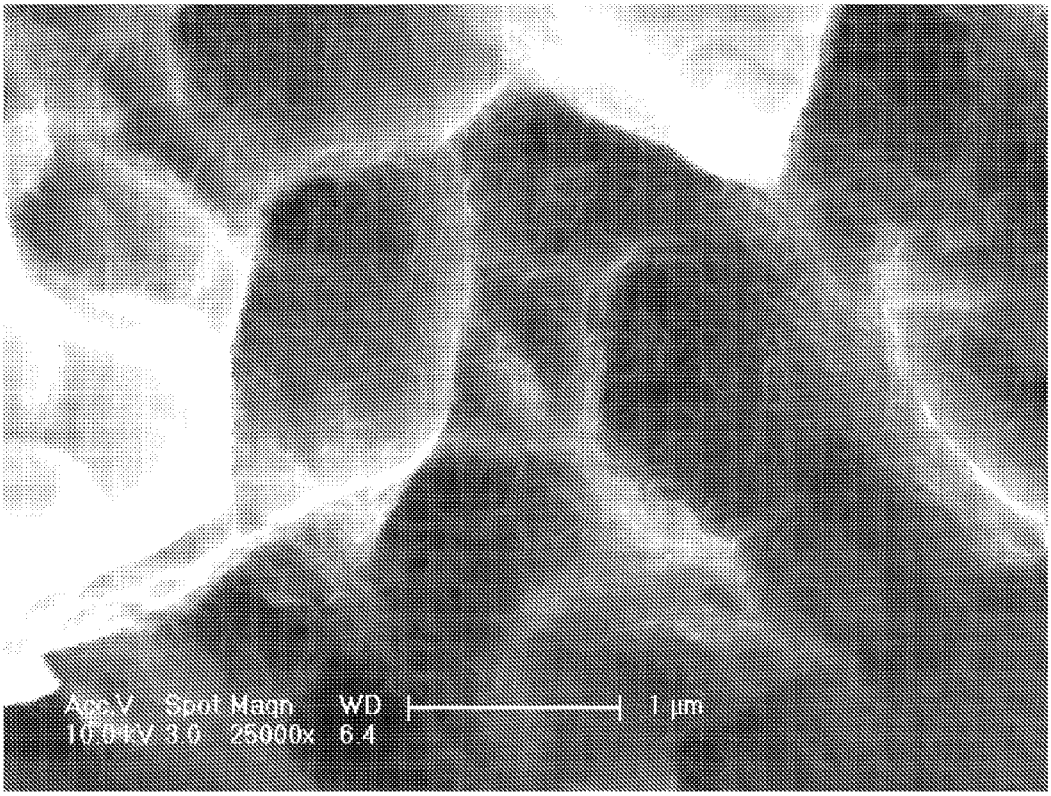
FIG. 2 illustrates a scanning electron microscope image of a fracture of a magnesium-based composite material produced by example 8.

An embodiment of a method for making a magnesium-based composite material is provided. The components of the magnesium-based composite material are CNTs and AZ91D magnesium alloy, the weight percentage of the CNTs in the magnesium-based composite material is 2.0 wt %. The method is similar to the method of example 5. The difference is that the weight of the CNTs is about 40 grams. Compared to the AZ91D magnesium alloy, the tensile strength of the magnesium-based composite material including CNTs of 2.0 wt % is improved about 8.6%, the yield strength is improved about 4.7% and the elongation percentage after broken is improved about 47.0%. Referring to FIG. 1, the carbon nanotubes are dispersed uniformly in the magnesium-based composite material. Referring to FIG. 2, the carbon nanotubes around the dimple fracture are dispersed uniformly.

When the magnesium-based material is in semi-solid-state, the magnesium-based material is stirred and the nanoscale reinforcements are added into the magnesium-based material during the stirring process. Because the viscous resistance of the semi-solid-state magnesium-based material is large, the nanoscale reinforcements are astricted by the magnesium-based material and hard to rise and fall. A swirl is produced when the magnesium-based material is stirred. Following the centrifugal force of the swirl motion, the nanoscale reinforcements can be dispersed into the whole magnesium-based material uniformly. Furthermore, the semi-solid-state magnesium-based material is hard to be oxidized compared with the liquid-state magnesium-based material. After the liquid-state magnesium-based composite material is high intensity ultrasonically processed, the nanoscale reinforcements are dispersed into the magnesium-based composite material both in macroscopy and microcosmos Depending on the embodiments, certain of the steps described in the description and claims may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

It is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A method for making a magnesium-based composite material, the method comprises the steps of:

S10, making a semi-solid-state magnesium-based material with a predetermined viscosity capable of absorbing at least one nanoscale reinforcement uniformly within the semi-solid magnesium-base material;

S20, dispersing the at least one nanoscale reinforcement uniformly into the semi-solid-state magnesium-based material;

S20.1, assisting absorption of the at least one nanoscale reinforcement into the semi-solid-state magnesium-based material by stirring the semi-solid-state mixture at a controlled speed during the dispersing;

S20.2, obtaining a semi-solid-state mixture of the at least one nanoscale reinforcement uniformly dispersed in and completely absorbed by the semi-solid-state magnesium-based material;

S30, heating the semi-solid-state mixture to a liquid-state mixture;

S40, ultrasonically processing the liquid-state mixture; and

S50, cooling the liquid-state mixture.

2. The method of claim 1, wherein the semi-solid-state magnesium-based material is a pure magnesium.

3. The method of claim 1, wherein the semi-solid-state magnesium-based material is a magnesium-based alloy, and the magnesium-based alloy comprises magnesium and other metals selected from the group consisting of zinc, manganese, aluminum, thorium, lithium, silver, calcium, and any combinations thereof.

4. The method of claim 1, wherein making of the semi-solid-state magnesium-based material is carried out in a vacuum environment.

5. The method of claim 1, wherein making of the semi-solid-state magnesium-based material is carried out in a protective gas environment, and the protective gas is selected from the group consisting of a nitrogen, a noble gas, and a mixture of carbon dioxide and sulfur hexafluoride.

6. The method of claim 5, wherein the step S10 further comprises substeps of:

S101, providing a solid-state magnesium-based material;

S102, heating the solid-state magnesium-based material to a temperature between a liquidus line and a solidus line of the solid-state magnesium-based material in the protective gas to obtain a semi-solid magnesium-based material preform; and S103, keeping the semi-solid magnesium-based material preform at the temperature for a period of time.

7. The method of claim 5, wherein the step S10 further comprises substeps of:

providing a solid-state magnesium-based material;

heating the solid-state magnesium-based material to a first temperature to obtain a liquid-state magnesium-based material, wherein the first temperature is at least 50° C. higher than a liquidus line of the solid-state magnesium-based material;

decreasing the temperature of the liquid-state magnesium-based material to a second temperature, wherein the second temperature is between the liquidus line and a solidus line of the solid-state magnesium-based material.

8. The method of claim 1, wherein the at least one nanoscale reinforcement comprises material selected from the group consisting of carbon nanotubes, silicon carbides, aluminum oxides, titanium carbides, boron carbides and any combinations thereof.

9. The method of claim 1, wherein the at least one nanoscale reinforcement is a particle with a diameter ranging from about 1.0 nanometer to about 100 nanometers.

10. The method of claim 8, wherein the at least one nanoscale reinforcement is carbon nanotube.

11. The method of claim 10, wherein an outer diameter of each carbon nanotube ranges from about 10 nanometers to about 50 nanometers, and a length of each carbon nanotube ranges from about 0.1 micrometers to about 50 micrometers.

12. The method of claim 1, wherein the stirring is carried out by a ultrasonic stirring or an electromagnetic stirring.

13. The method of claim 1, wherein a frequency of the ultrasonic processing ranges from about 15 KHz to about 20 KHz.

14. The method of claim 1, wherein the at least one nanoscale reinforcement comprises a plurality of nanoscale reinforcements, and each of the nanoscale reinforcements is enclosed in and directly in contact with the semi-solid-state aluminum-based material.

15. The method of claim 1, wherein the step S50 further comprises the following substeps of:

increasing the temperature of the liquid-state mixture to a pouring temperature;

pouring the liquid-state mixture into a mold; and cooling the mold.

16. The method of claim 15, wherein the mold is preheated to a temperature ranging from about 200° C. to about 300° C.

17. The method of claim 15, wherein the pouring temperature ranges from about 650° C. to about 700° C.

18. A method for making a magnesium-based composite material, the method comprises the steps of:

S10, making a semi-solid-state magnesium-based material with a predetermined viscosity capable of absorbing at least one nanoscale reinforcement uniformly within the semi-solid magnesium-base material in a protective gas environment or a vacuum environment;

S20, dispersing the at least one nanoscale reinforcement uniformly into the semi-solid-state magnesium-based material;

S20.1, assisting absorption of the at least one nanoscale reinforcement into the semi-solid-state magnesium-based material by stirring the semi-solid-state mixture at a controlled speed during the dispersing;

S20.2, obtaining a semi-solid-state mixture of the at least one nanoscale reinforcement uniformly dispersed in and completely absorbed by the semi-solid-state magnesium-based material;

S30, heating the semi-solid-state mixture to a liquid-state mixture;

S40, ultrasonically processing the liquid-state mixture; and

S50, cooling the liquid-state mixture.

* * * * *